United States Patent [19]

Cook

[11] 4,113,600

[45] Sep. 12, 1978

[54] FLUE PIPE ANODE RING FOR WATER HEATER

[75] Inventor: Robert E. Cook, Kankakee, Ill.

[73] Assignee: A. O. Smith Corporation, Milwaukee, Wis.

[21] Appl. No.: 789,643

[22] Filed: Apr. 21, 1977

[51] Int. Cl.[2] ..... C23F 13/00

[52] U.S. Cl. ..... 204/197; 204/148

[58] Field of Search ..... 204/197, 148

[56] References Cited

U.S. PATENT DOCUMENTS

| | | | |
|---|---|---|---|
| 2,459,123 | 1/1949 | Bates et al. | 204/197 |
| 2,764,427 | 9/1956 | Andrus | 204/196 |
| 3,864,234 | 2/1975 | Wasson | 204/197 |

*Primary Examiner*—T. M. Tufariello

*Attorney, Agent, or Firm*—Andrus, Sceales, Starke & Sawall

[57] ABSTRACT

An anode adherred to a flue pipe which consists of anodic metal like zinc, aluminum or magnesium flame sprayed in the form of a ribbon, strip or ring onto exposed metal at the upper end of the flue pipe beneath the upper head of a water heater. The anodic metal overlaps the glass coating on the flue at the joint between the glass and anodic metal and has a press fit with the upper head to eliminate any problem of corrosion at the joint area between the flue and upper head.

1 Claim, 2 Drawing Figures

FLUE PIPE ANODE RING FOR WATER HEATER

BACKGROUND OF THE INVENTION

In a water heater employing a central flue, air tends to accumulate in the upper portion of the tank of the heater around the flue and below the upper head and because of the oxygen and moisture present in that area, the upper end of the flue below the head is extremely susceptible of corrosion. The invention overcomes the problem by specially applied anodic metal on the flue in the area subject to corrosive attack.

SUMMARY OF THE INVENTION

In general the invention is directed to an anode which is flame sprayed onto the upper portion of exposed metal of a flue located below the upper head of a water heater with the anodic metal being provided generally in the form of a ribbon or strip of metal encircling the flue. The metal adheres directly to the exposed metal of the flue which is devoid of a glass coating at the sprayed area and the flame sprayed metal beside covering the exposed metal of the flue overlaps the glass coating on the flue below the sprayed metal to eliminate any crevice between the glass coating and anodic metal.

DESCRIPTION OF THE PREFERRED EMBODIMENT

Figure 1:
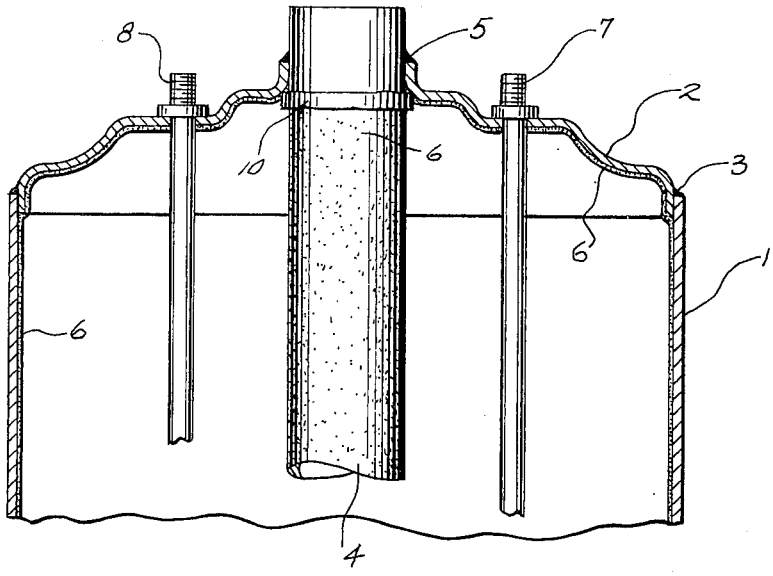
FIG. 1 is a cross sectional view of the upper portion of a gas fired water heater tank with parts in elevation.

Referring to the drawing the water heater there shown in part illustrates a shell 1, an upper head 2 which is secured to shell 1 by weld 3 and a central flue 4. The upper end portion of flue 4 protrudes through an openng in head 2 and is joined to head 2 by the annular weld 5. The inner surfaces of the shell, head and the outer surface of the flue are coated with glass 6 to protect these surfaces from corrosion from the stored water.

The inlet pipe 7 and outlet pipe 8 extend through upper head 2 and into the tank. Normally the inside of the tank is additionally protected by an anode rod, not shown, which is secured to upper head 2.

The invention provides a secondary anode 9 around the upper end of flue 4 below the upper head 2.

In the assembly of the water heater tank, flue 4 is welded at the lower end to a lower head of the tank, not shown, and then is provided with the glass coating 6 on the outside surfaces. Shell 1 and upper head 2 are then separately secured together and coated on the inside with glass coating 6.

Figure 2:
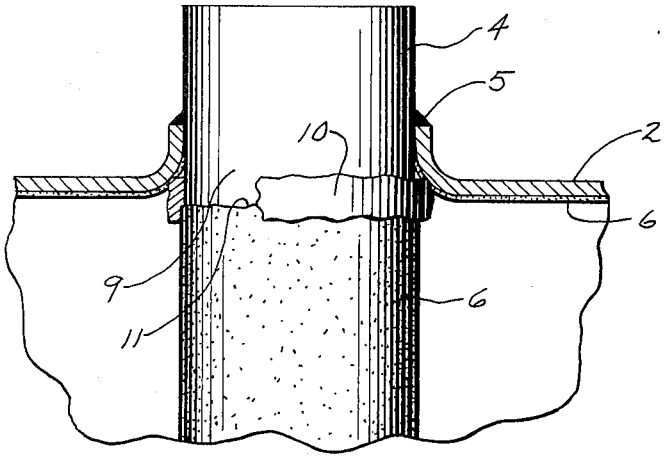
FIG. 2 is a view similar to FIG. 1 with parts broken away to illustrate the overlapping of the glass coating by the anodic metal.

After the glass has been applied to flue 4 before firing to fuse the glass to form coating 6 on flue 4, the glass is brushed back at the upper end of flue 4 to expose the metal of flue 4 from the outer end of flue 4 to slightly below the upper head 2 as shown at 9 in FIG. 2.

Anode 10 is bonded to the exposed metal 9 which will be located below head 2 as in FIGS. 1 and 2 such as by flame spraying anodic metal of the order of zinc, aluminum or magnesium thereon. Upon the spraying method a wire of the anodic material is fed through the center of a flame such as an acetylene torch and the air velocity provided to the flame sprays the anodic metal as it is dissipated from the wire onto the exposed metal 9 to provide anode 10, in the form of a strip, ribbon or ring of material.

The anode 10 which is formed as described not only is adhered to metal 9 of flue 4 but also is sprayed over the upper end 11 of the glass coating 6 on flue 4. This eliminates any metal 9 on flue 4 exposed between the coating 6 and anode 10.

The sprayed anode 10 forms an excellent mechanical bond with metal 9 of flue 4 and consequently a very desirable electrical contact with metal 9 of flue 4. It also is applied so there is a more consistent fit up with the upper head 2.

When flue 4 and lower head are assembled with shell 1 and upper head 2 and flue 4 is welded to upper head 2, it is desirable that anode 10 be so located on flue 4 to have a press fit with head 2 so as to limit the contact of the corrosive medium present in the area with the metal of the flue 4 which might be exposed between the head 2 and flue 4.

Although the invention has been described with respect to the employment of the single flue 4 it also would be employed in the event a plurality of flues 4 were used.

The invention provides secondary anodic protection of the upper portion of flue 4 immediately below upper head 2 of the water heater where corrosive medium has been found to accumulate and cause corrosive damage to the flue.

Various modes of carrying out the invention are contemplated as being within the scope of the following claims particularly pointing out and distinctly claiming the subject matter which is regarded as the invention.

I claim:

1. In a water heater having a shell and an upper head secured to the shell and a glass coating fused to the inside of the shell and head, a metal flue extending through the upper head and secured to the head to provide a tight joint therebetween to discharge products of combustion, a glass coating on the outside of the flue extending to a line slightly removed from the inside of the upper head to expose the metal of the flue below the upper head, and anodic metal selected from the group consisting of zinc, aluminum and magnesium flame sprayed in the form of a continuous strip of metal on the exposed metal of the flue in intimate mechanical bond and electrical contact therewith and over the upper terminating end portion of the glass coating on the flue and into the joint between the head and shell to provide a press fit with the head and shell and a more consistent fit between the upper head and shell and operate as a separate located anode to protect any exposed metal of the flue directly below the upper head from corrosion.

* * * * *